US006843188B2

(12) United States Patent
Sakakibara et al.

(10) Patent No.: US 6,843,188 B2
(45) Date of Patent: Jan. 18, 2005

(54) SEWING MACHINE

(75) Inventors: Kaoru Sakakibara, Aichi (JP); Masayuki Hori, Gifu (JP)

(73) Assignee: Brother Kogyo Kabushiki Kaisha, Nagoya (JP)

( * ) Notice: Subject to any disclaimer, the term of this patent is extended or adjusted under 35 U.S.C. 154(b) by 0 days.

(21) Appl. No.: 10/395,118

(22) Filed: Mar. 25, 2003

(65) Prior Publication Data

US 2003/0183143 A1 Oct. 2, 2003

(30) Foreign Application Priority Data

Mar. 28, 2002 (JP) ..... 2002-091551
Mar. 28, 2002 (JP) ..... 2002-091552
Mar. 28, 2002 (JP) ..... 2002-091553

(51) Int. Cl.[7] ..... D05B 69/30; D05B 73/02
(52) U.S. Cl. ..... 112/220; 112/259
(58) Field of Search ..... 112/220, 258, 112/225, 259, 241

(56) References Cited

U.S. PATENT DOCUMENTS 418,890 A * 1/1890 Dimond et al. ..... 112/220
3,420,200 A * 1/1969 Johnson ..... 112/258
4,044,701 A * 8/1977 Giesselmann et al. ..... 112/259
4,590,875 A * 5/1986 Sanvito et al. ..... 112/168
5,003,900 A * 4/1991 Ogawa ..... 112/242
5,253,601 A * 10/1993 Sanvito ..... 112/320
5,441,003 A 8/1995 Hashiride

* cited by examiner

*Primary Examiner*—Ismael Izaguirre
(74) *Attorney, Agent, or Firm*—Oliff & Berridge, PLC

(57) ABSTRACT

A sewing machine includes a mounting member, a needle bar driving mechanism, and a needle thread take-up driving mechanism. The mounting member has two sides mounted on the left and right of the needle bar driving mechanism and the needle thread take-up driving mechanism, respectively. The mounting member is supported on one of the sides by the main shaft, a rotating shaft rotated with the main shaft or a bearing member for the main shaft or the rotating shaft so that the mounting member is rotated relative to the machine frame and the main shaft or rotating shaft. The mounting member is supported on the other side by the main shaft or a supporting shaft substantially concentric with the rotating shaft and extending in a same direction as the rotating shaft so that the mounting member is rotated relative to the machine frame and the main shaft or rotating shaft.

32 Claims, 12 Drawing Sheets

SEWING MACHINE

BACKGROUND OF THE INVENTION

1. Field of the Invention

This invention relates to a sewing machine including mechanisms for driving a needle bar, a needle thread take-up, etc. respectively.

2. Description of Related Art

In conventional sewing machines, components are assembled into modules for driving a needle bar, a needle thread take-up, etc. The modules are sequentially mounted on a die-cast frame. Thus, a needle bar driving mechanism and a needle thread take-up mechanism are mounted on the frame as respective modules. Positions of the mechanisms need to be adjusted relative to a shuttle located below the mechanisms since the mechanisms are mounted on a frame of a sewing arm of the machine. These mechanisms need to be located close to each other and to have a predetermined positional relation to each other. Accordingly, the productivity of sewing machines would be improved when components required to perform a function are assembled into a single module and the positions of the components are adjusted in the module before the module is mounted on the frame.

In assembling components required to perform a function into a single module, desired positional relations among the components can easily be obtained when the components can be mounted on a common member. For example, a conventional sewing machine includes a sewing bed further including a left end which will be referred to as "head." A part of the frame in the head may be separable from another part of the frame, and the components performing the respective above-described functions may be assembled onto the frame of the head. However, when the components are assembled onto the frame of the head, the weight of the head including these components is increased, and a junction between the frame of the head and another frame part is cantilevered to be rendered large-sized, whereupon the size of the sewing machine is increased. In view of the problem, it is suggested that the functional components be mounted on a plate-shaped member discrete from the frame without separation of the frame and the plate-shaped member be further mounted on the frame.

However, operations of the mechanisms and superimposition of the components cause load when the components of the needle bar driving and needle thread take-up mechanisms are mounted on the single plate-shaped member. Consequently, the plate-shaped member needs to have a high stiffness. Accordingly, since a mere plate-shaped member cannot support the components of the mechanisms, the components cannot be assembled into respective modules, whereupon the productivity of sewing machines is low.

SUMMARY OF THE INVENTION

Therefore, an object of the present invention is to provide a sewing machine having a high productivity.

The present invention provides a sewing machine comprising a needle bar driving mechanism for vertically moving a needle bar by rotation of a main shaft, a needle thread take-up driving mechanism interlocked with vertical movement of the needle bar for vertically moving a needle thread take-up by rotation of the main shaft, a mounting member on which the needle bar driving mechanism and the needle thread take-up driving mechanism are mounted, and a machine frame supporting the mounting member. In the machine, the mounting member has two opposite sides provided on the left and right of the needle bar driving mechanism and the needle thread take-up driving mechanism respectively. The mounting member is supported, at one of the sides thereof, by the main shaft, a rotating shaft rotated with the main shaft or a bearing member for the main shaft or the rotating shaft so that the mounting member is rotated relative to the machine frame and the main shaft or the rotating shaft. The mounting member is supported, at the other side thereof, by the main shaft or a supporting shaft substantially concentric with the rotating shaft and extending in a same direction as the rotating shaft does so that the mounting member is rotated relative to the machine frame and the main shaft or the rotating shaft. The mounting member is fixed by a fixing member so that rotation thereof is disallowed.

In the foregoing sewing machine, the two sides of the mounting member are rotatably supported, and load caused by the needle bar driving mechanism and the needle thread take-up driving mechanism is dispersed. Accordingly, both mechanisms can be supported on the mounting member. Furthermore, both mechanisms are adjusted by rotating the mounting member. Consequently, the productivity of the sewing machine can be improved.

In a preferred form, the sides of the mounting member are formed from a resin integrally with each other so that the sides are spaced from each other in a right-and-left direction. The sides of the mounting member have ribs formed thereon so as to protrude axially with respect to the main shaft or the rotating shaft and further formed annularly so as to surround a portion of said one side supported by the main shaft or the rotating shaft and a portion of said other side supported by the supporting shaft, respectively. The annularly protruding ribs have further ribs formed to extend in a line linearly so as to be perpendicular thereto as viewed from a direction in which the ribs protrude, respectively.

In another preferred form, a threading mechanism for threading a needle attached to a lower end of the needle bar is mounted on the mounting member as well as the needle bar driving mechanism and the needle thread take-up driving mechanism. A limiting member is provided for limiting movement of the mounting member relative to the machine frame concerning a predetermined direction other than a direction in which the mounting member is mounted on the machine frame. In this construction, the machine frame preferably has a front formed with an opening, and the mounting member is mounted on the front of the machine frame. Additionally, the limiting member allows movement of the mounting member relative to the machine frame both in a back-and-forth direction and vertically and limits horizontal movement of the mounting member which is the predetermined direction.

In further another preferred form, the mounting member is made from a resin and includes mounting portions on which the needle bar driving mechanism, needle thread take-up driving mechanism and threading mechanism are mounted respectively and a limiting portion serving as the limiting member in cooperation with the limiting of the machine frame side, the mounts and the limiting portion being formed integrally with the mounting member. Furthermore, either one of the limiting portions provided at the machine frame side and formed in the mounting member is a protrusion extending in the back-and-forth direction and the other is a recess into which the protrusion is inserted.

Furthermore, when the threading mechanism is mounted on the mounting member as well as the needle bar driving mechanism and the needle thread take-up driving mechanism, the mounting member preferably includes a vertical plane substantially perpendicular to a back-and-forth direction, two sides substantially perpendicular to the vertical plane and extending forward and a connecting portion connecting the sides together at an opposite side spaced away from the vertical plane. In this construction, the mounting member is preferably made from a resin. The vertical plane and the two sides are formed integrally with each other. Either one of the two sides includes an outer middle portion so bent as to form an obtuse angle as viewed in a direction opposite to the direction in which the side of the mounting member projects.

The needle bar driving mechanism and the needle thread take-up driving mechanism are preferably mounted on the mounting member so that the mounting member and the mechanisms constitute a module. The module is assembled to a machine frame.

BRIEF DESCRIPTION OF THE DRAWINGS

Other objects, features and advantages of the present invention will become clear upon reviewing the following description of an embodiment, made with reference to the accompanying drawings, in which.

DETAILED DESCRIPTION OF THE INVENTION

Figure 1:
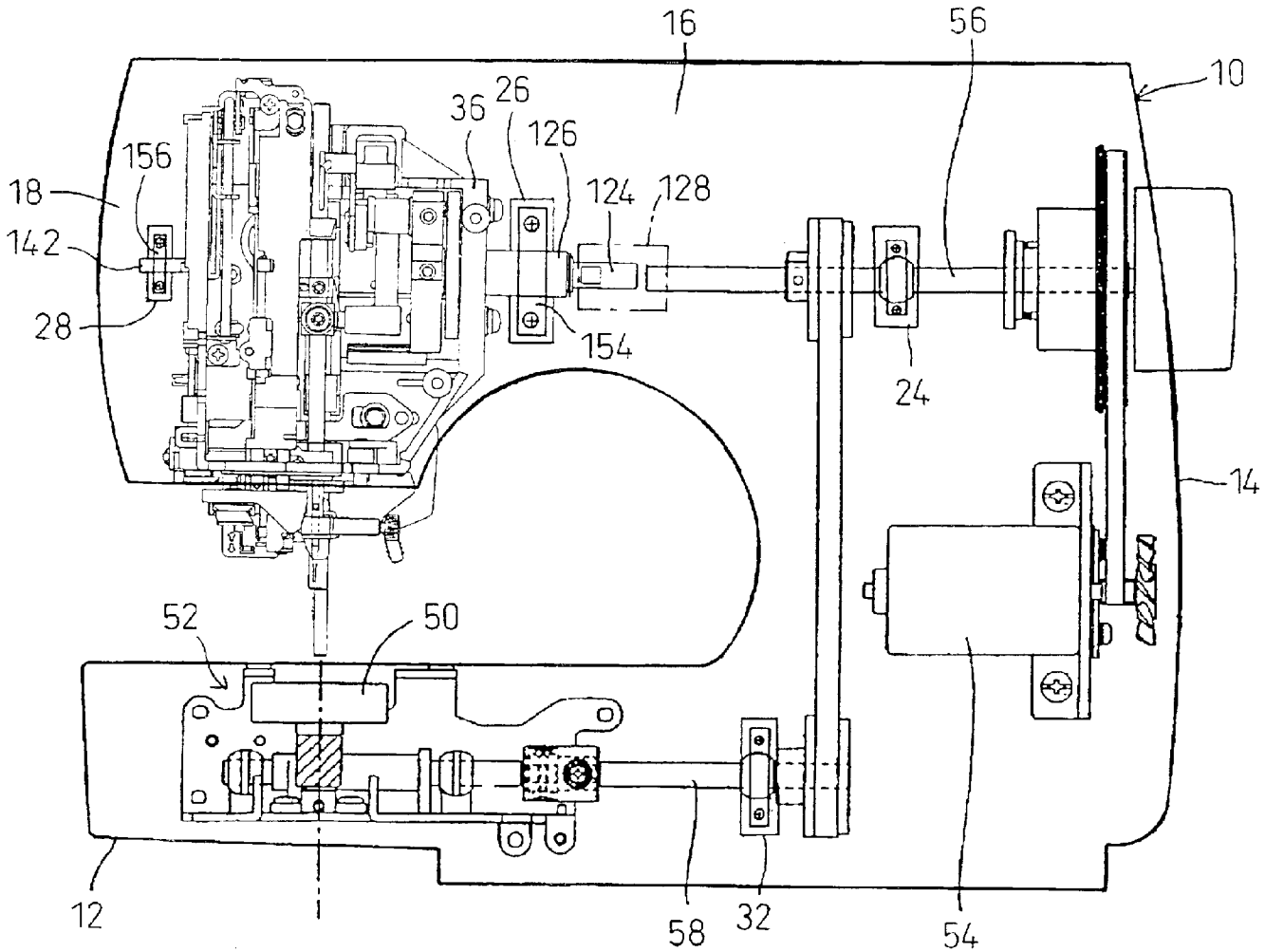
FIG. 1 is a front sectional view showing an overall construction of a sewing machine in accordance with one embodiment of the invention.
Figure 2A:
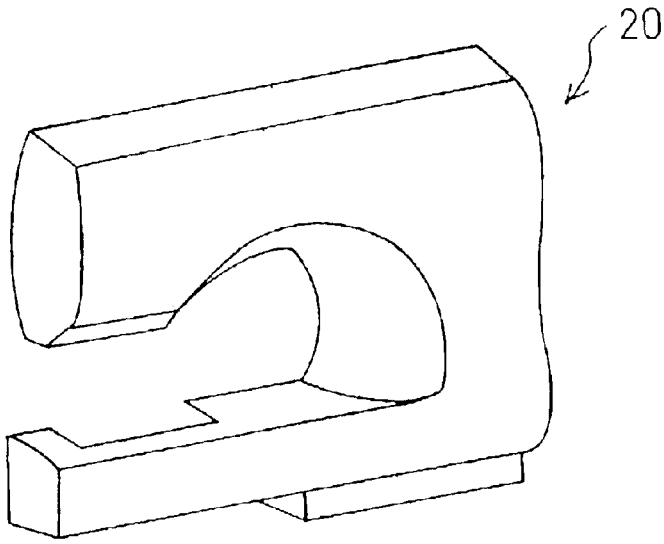
FIGS. 2A and 2B are perspective views of a front frame and a rear frame respectively.
Figure 2B:
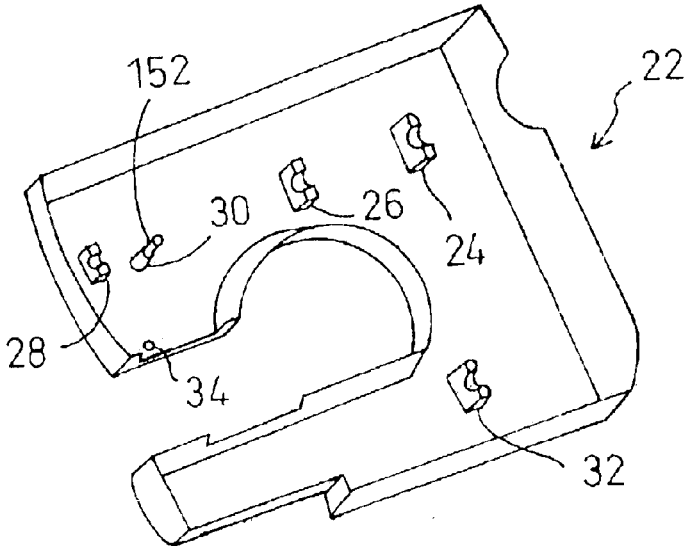
Figure 3:
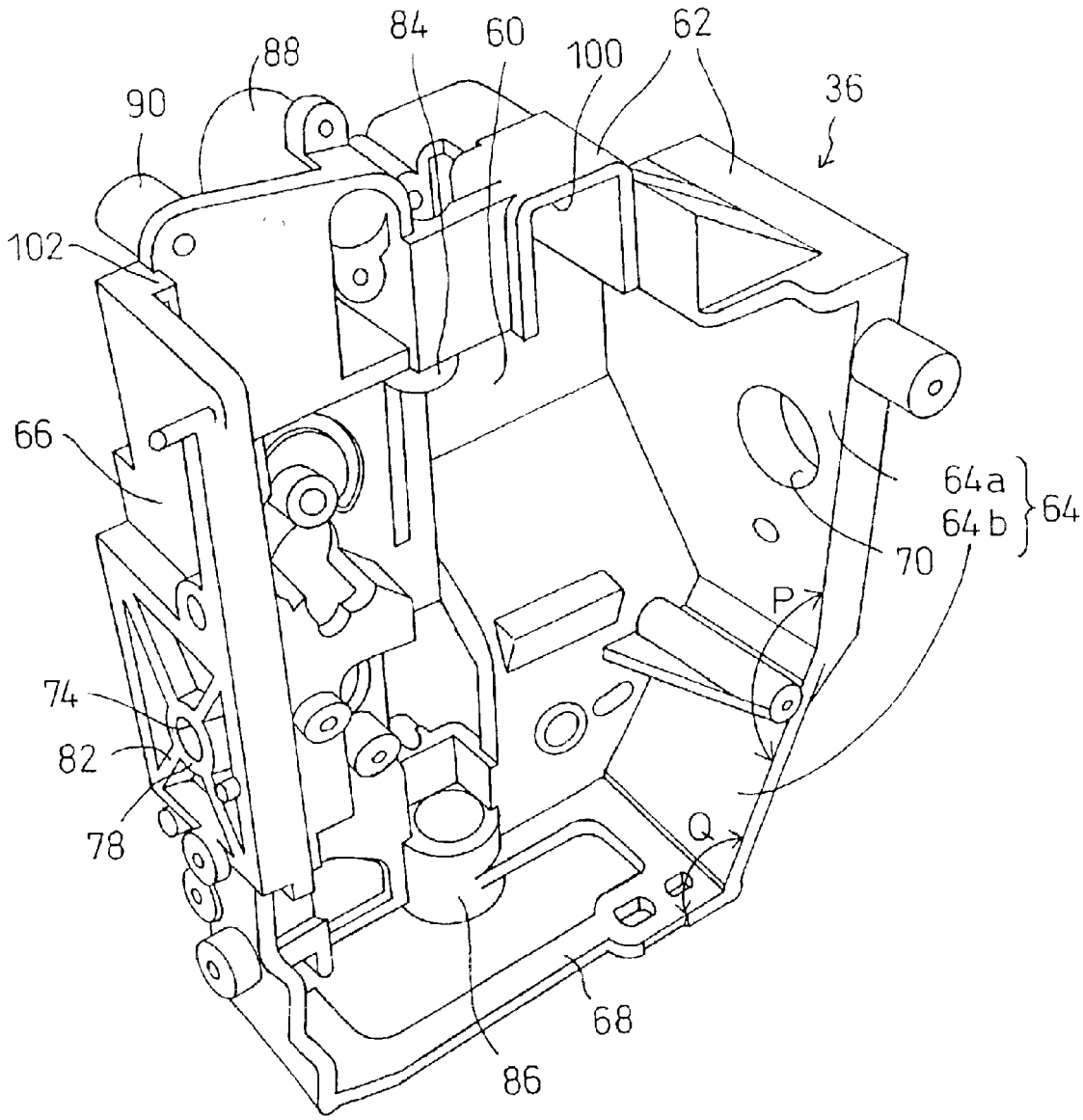
FIG. 3 is a perspective view of a mounting member.
Figure 4:
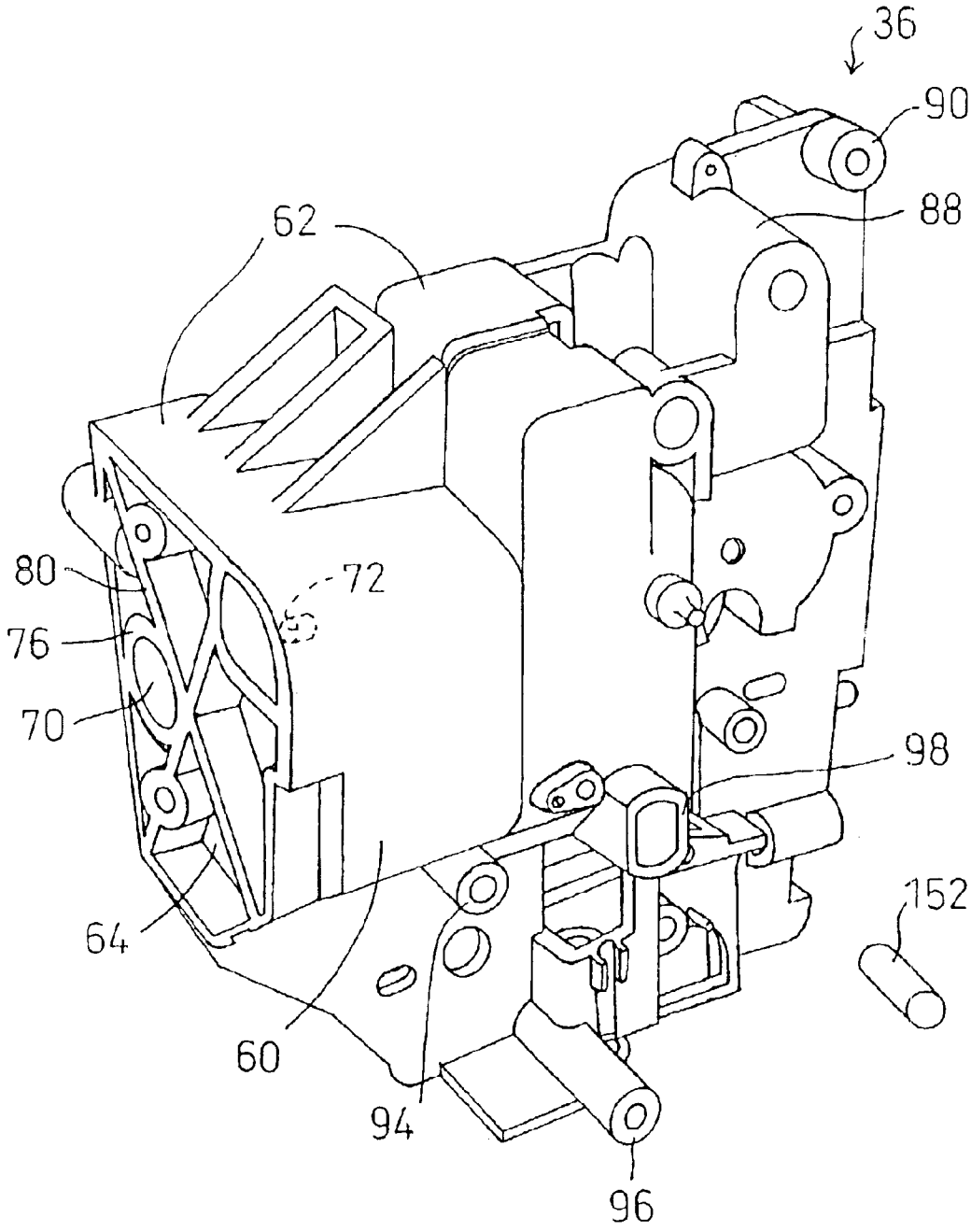
FIG. 4 is a perspective view of the mounting member as viewed at a different angle from FIG. 3.
Figure 5:
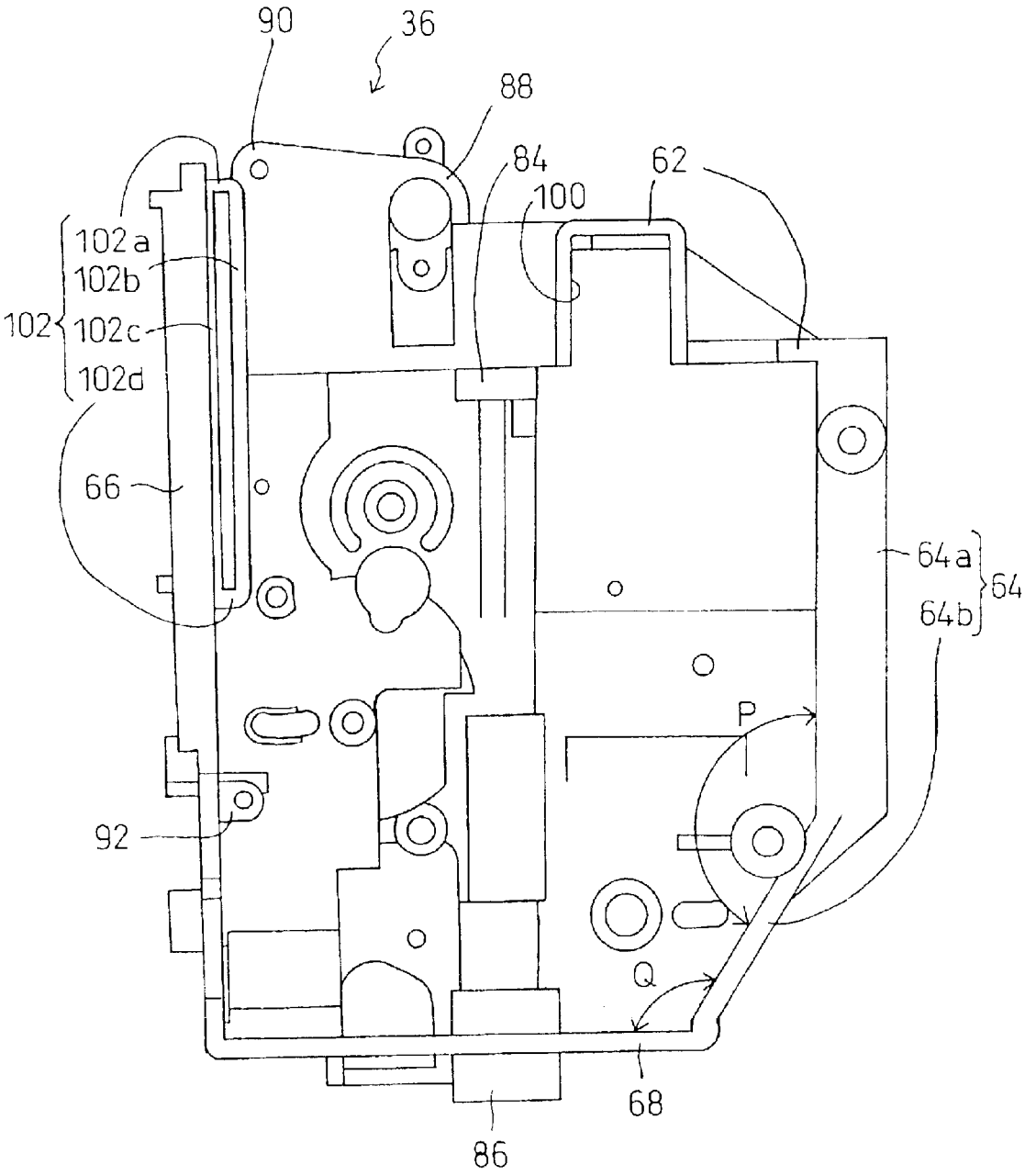
FIG. 5 is a front view of the mounting member.
Figure 6:
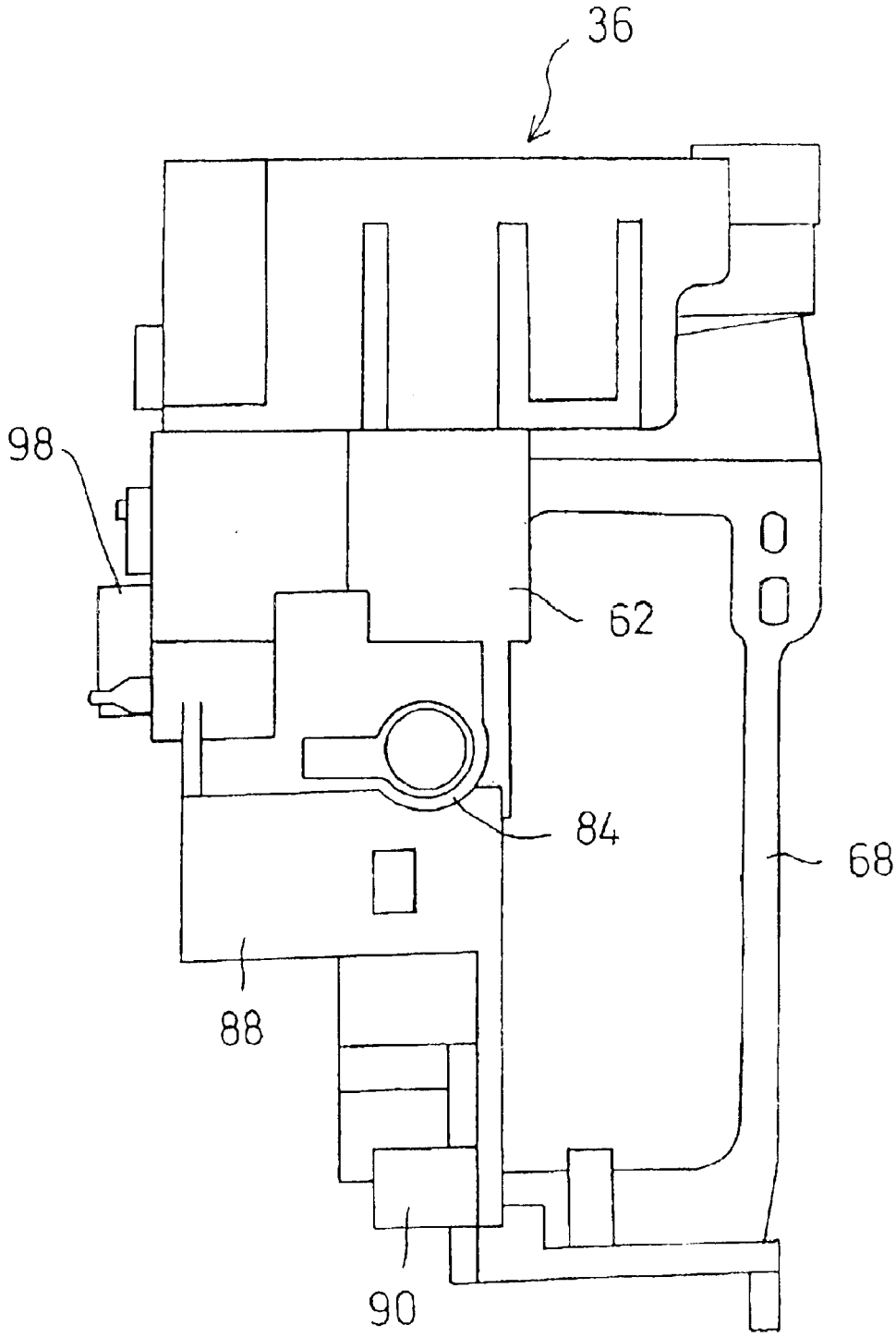
FIG. 6 is a plan view of the mounting member.
Figure 7:
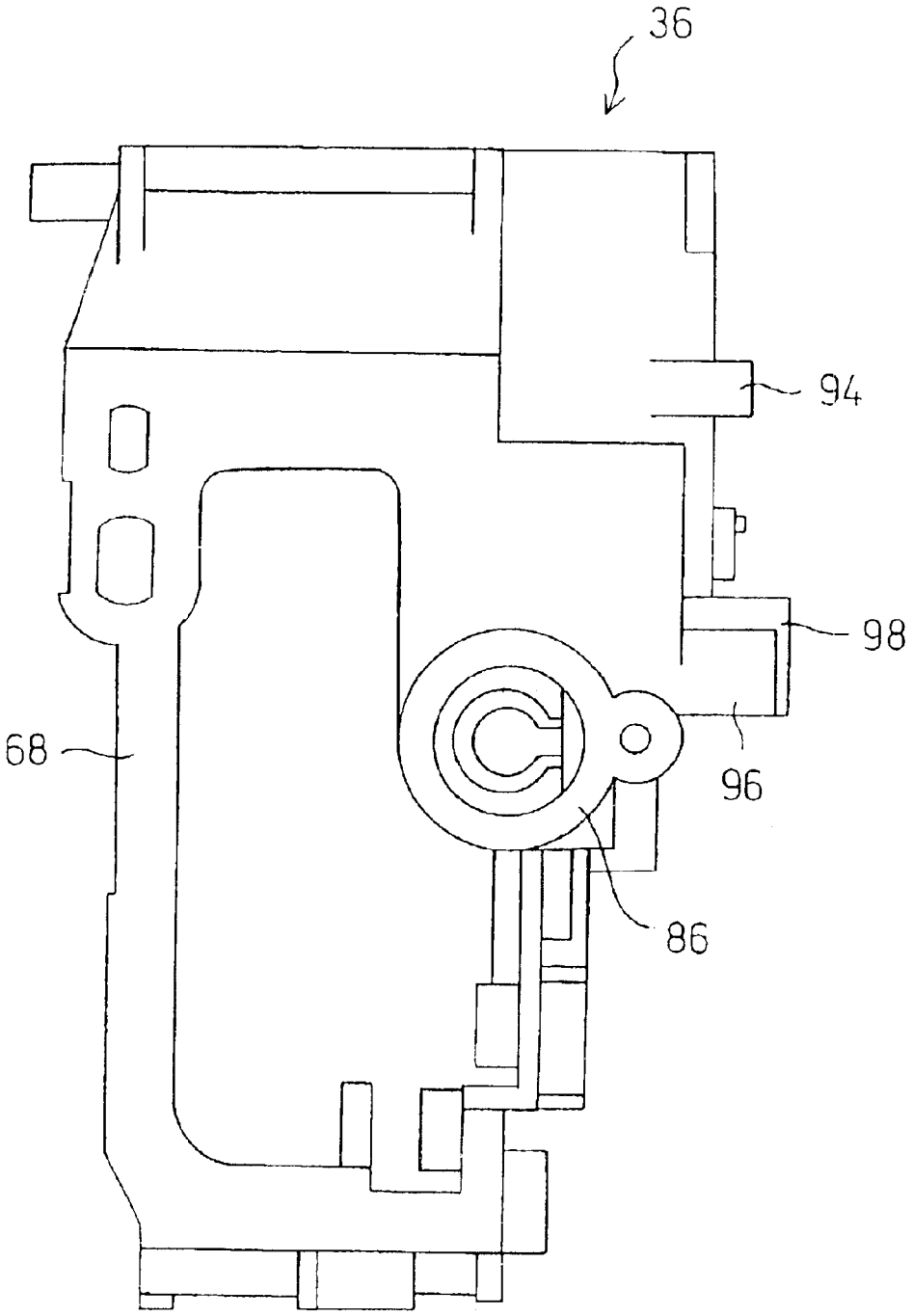
FIG. 7 is a bottom view of the mounting member.

A first embodiment of the invention will be described in detail with reference to the accompanying drawings. Referring to FIG. 1, a sewing machine 10 in accordance with the invention comprises a sewing bed 12 having a horizontal plane on which cloth to be sewn is placed, a pillar 14 extending upward from a right-hand portion of the bed 12, a sewing arm 16 extending horizontally rightward from the pillar 14 so as to be opposed to the bed 12 or located over the bed, and a head 18 located on the left of the arm 16. The bed 12, pillar 14, arm 16 and head 18 are formed continuously into a front frame 20 and a rear frame 22 both of which are made from a resin, as shown in FIGS. 2A and 2B. The front frame 20 has a rear opening and is forwardly recessed. The rear frame 22 has a front opening and is rearwardly recessed.

The openings of the frames 20 and 22 are put together such that a closed space is defined by the two frames. In order that mechanisms which will be described later may be mounted and supported on the front of the rear frame 22 in the space, inner faces of the frames 20 and 22 have a number of mounts 24, 26, 28, 30, 32 and a female screw 34 all of which are formed integrally together by way of resin mold. The female screw 34 is formed by engaging a male screw with resin such that part of the resin is scraped off by the screw thread, whereupon a hole serving as the female screw is formed. Reinforcing ribs (not shown) are formed on the inner faces of the frames 20 and 22 so that sufficient rigidity is obtained to support the mechanisms which will be described later. Japanese Patent Application No. 2001-295564 filed by the assignee of the present application discloses a sewing machine in which a mechanism is directly mounted and supported on the front of the rear frame 22.

A mounting member 36 made from a resin as shown in FIGS. 3 to 8 is enclosed in the head 18. Three mechanisms performing three functions respectively are mounted on the mounting member 18 as shown in FIG. 9. The mechanisms include a needle bar driving mechanism 40 for vertically moving a needle bar 38, a needle thread take-up driving mechanism 44 interlocked with vertical movement of the needle bar for vertically moving a needle thread take-up 42, and a threading mechanism 48 for threading a needle 46 attached to a lower end of the needle bar 38. Furthermore, a shuttle driving mechanism 52 is provided in the bed 12 and includes a horizontally rotating shuttle 50 forming stitches in cooperation with the needle 46. The needle bar driving mechanism 40, needle thread take-up driving mechanism 44 and shuttle driving mechanism 52 are mechanically coupled to one another. These mechanisms are operated in synchronization with one another by a main shaft 56 or a lower shaft 58 both of which are rotated by a machine motor 54 mounted on the rear frame 22.

The mounting member 36 will now be described in detail. The mounting member 36 includes a vertical wall 60 generally perpendicular to the back-and-forth direction, a top 62 extending forward from an upper end of the vertical wall 60, two side walls 64 and 66 substantially perpendicular to the vertical wall 60 and extending forward from opposite side ends respectively and a connecting wall 68 located vertically opposite to the vertical wall 60 to connect the side walls 64 and 66. These walls are formed integrally from a resin so as to have a substantially uniform thickness (3 mm). The two side walls 64 and 66 are spaced crosswise from each other, and the connecting wall 68 extends crosswise. The connecting wall 68 has a crosswise middle opening and extends from the side walls 64 and 66 so as to be substantially perpendicular to the side walls.

The side walls 64 and 66 of the mounting member 36 are thus connected to a plurality of walls, that is, the vertical wall 60, top 62 and connecting wall 68. The mounting member 36 is rearwardly recessed thereby to be formed into the shape of a box and has a front space which is defined by the above-described walls and in which various components are located. The left side wall 66 has substantially the same length as the vertical wall 60. The right side wall 64 includes a vertically extending wall 64*a* which is shorter than the vertically longest portion of the vertical wall 60 and a lower inclined wall 64*b* inclined rightward upward. An angle P formed by the vertical wall 64*a* and the inclined wall 64*b* is obtuse. Consequently, the mounting member 36 has an improved rigidity. More specifically, the right side wall 64 includes an outer middle portion so bent as to form an obtuse angle as viewed in a direction opposite to the direction in which the right side of the mounting member projects.

Accordingly, the mounting member 36 has a higher rigidity than the construction in which a right side wall is not bent so as to form an obtuse angle. Furthermore, the lower wall 64*b* is connected to the connecting wall 68. An angle Q formed between the lower wall 64*b* and the connecting wall 68 is also obtuse. Consequently, the rigidity of the mounting member 36 is further improved.

The side walls 64 and 66 and the vertical wall 60 have the following mounting portions formed integrally from a resin. The right side wall 64 has two through holes 70 and 72. The left side wall 66 has a rightward recess 74 formed integrally therewith so as to be recessed rightwards from an outer face thereof. The recess 74 has an innermost vertical wall and accordingly does not extend through the left side wall 66. The recess 74 has a circular opening as viewed at the left side. The circular opening of the recess 74 is concentric with the through hole 70 of the right side wall 64. Since the recess 74 is not a through hole, the mounting member 36 has a higher rigidity than the case where the recess 74 is a through hole.

An annular rib 76 is formed around the through hole 70 of the right side wall 64. The annular rib 76 projects 3 mm rightwards. An annular rib 78 having a thickness of 3 mm is formed around the recess 74 of the left side wall 66. The annular rib 78 projects leftwards. The recess 74 is recessed 1.5 mm rightwards though the left side wall 66 has a thickness of 3 mm. Accordingly, an amount of rightward recess of the recess 74 is 4.5 mm. More specifically, an overall thickness of the left side wall 66 is not set at 4.5 mm but the annular rib 78 is partially formed in the left side wall, whereby a necessary amount of recess is ensured. Consequently, disadvantage due to a large thickness such as buckle, sink mark, shrink or warp can be overcome.

The right and left side walls 64 and 66 further have two generally X-shaped ribs 80 and 82 respectively. The X-shaped ribs 80 and 82 are continuous to the annular ribs 76 and 78 respectively. The X-shaped rib 80 projects in the same direction and has the same amount of projection as the annular rib 76. The X-shaped rib 82 also projects in the same direction and has the same amount of projection as the annular rib 78. Consequently, the rigidity of the mounting member 36 is higher when the mounting member is provided with the ribs 76, 78, 80 and 82 than when the mounting member is provided with no ribs and when the ribs 80 and 82 are discontinuous from the ribs 76 and 78 respectively.

The vertical wall 60 has two vertical through holes 84 and 86 formed in generally middle portions of the upper and lower ends thereof respectively. The upper hole 84 has a generally keyhole-like opening as viewed from above, whereas the lower hole 86 has a generally circular opening. The holes 84 and 86 are concentric with each other. The vertical wall 60 further has two horizontal through holes 88 and 90 formed integrally on the left of the vertical hole 84 in the upper end thereof. Both through holes 88 and 90 extend back and forth. Furthermore, the left side wall 66 has a horizontal through hole 92 formed integrally therewith and extending back and forth. Additionally, the vertical wall 60 has two rearwardly projecting annular portions 94 and 96 formed integrally on the rear face thereof. The upper annular portion 94 has a through hole extending back and forth, whereas the lower annular portion 96 is perpendicular to the vertical hole 86 and does not extend through the vertical wall 60.

The following portions are formed integrally from the resin with the mounting member 36 as well as the above-described mounting portions. The vertical wall 60 serving as the rear of the mounting member 36 has a cylindrical protrusion 98 formed integrally therewith and projecting rearward from the outer face thereof. Part of a limiting member is disposed in the rear of the mounting member 36. Accordingly, since no part of the limiting member is disposed in the space ahead of the mounting member 36, a degree of freedom is increased in the arrangement of components disposed in the space ahead of the mounting member 36, and a spare space used to escape part of the limiting member is not required. Consequently, the size of the mounting member 36 can be reduced. Furthermore, since the front side of the cylindrical protrusion 98 is closed, the mounting member 36 has a higher rigidity than in the case where the cylindrical protrusion 98 extends through the vertical wall 60.

The mounting member 36 includes an escape portion 100 formed on the right of the upper hole 84. The escape portion 100 is recessed upward and rearward and includes a flat upper face 62. Accordingly, an upper right half portion of the vertical wall 60 is located in the rear of a left half portion and a lower portion of the right half portion. The mounting member 36 includes a portion between an upper part of the right half portion and a lower part of the right half portion of the mounting member 36. The portion is inclined rearwardly upward. Thus, since the upper face 62 is also provided on the upper end of the escape portion 100, the mounting member 36 has a higher rigidity than in the case where the upper end has no upper face 62.

A junction between the vertical wall 60 and the left side wall 66 is formed with ribs 102*a* to 102*d* extending in the back-and-forth direction and projecting forward. A threading groove 102 is formed integrally along the junction and includes a grove extending vertically. The threading groove 102 includes an upper groove 102*a*, two parallel ribs 102*b* and 102*c* extending downward from both ends of the upper groove 102*a* respectively and a lower rib 102*d* connecting the parallel ribs 102*b* and 102*c*. These ribs 102*a* to 102*d* extend forward so as to be perpendicular to the vertical wall 60. Furthermore, the rib 102*c* extends rightward so as to be perpendicular to the right face of the left side wall 66. The rib 102*c* is formed along a junction between the vertical wall 60 and the left side wall 66. The ribs 102*b* and 102*c* define a vertically extending groove into which a component of the threading mechanism 48 mounted on the mounting member 36 is inserted to be slid therein, as will be described later. Accordingly, the junction has a higher rigidity than in the case where the junction has no such ribs of the threading groove 102.

Figure 10:
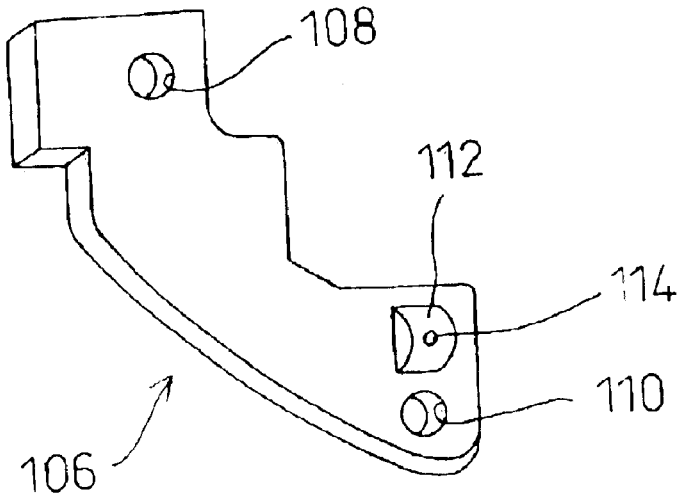
FIG. 10 is a perspective view of an abutment plate.
Figure 11:
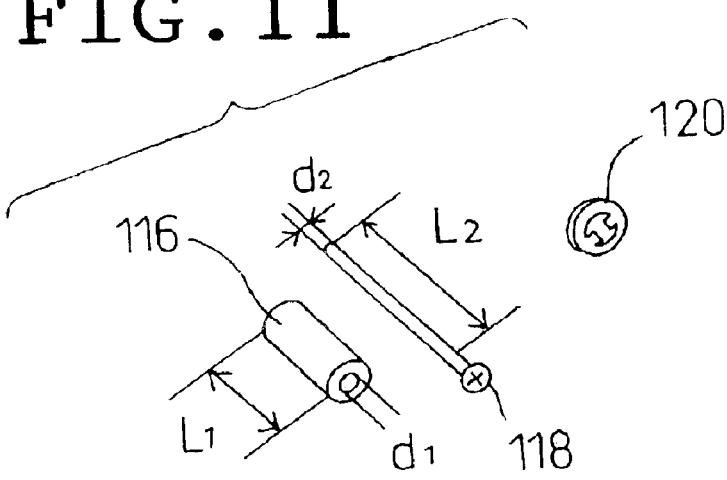
FIG. 11 is a perspective view of an adjusting screw.
Figure 12:
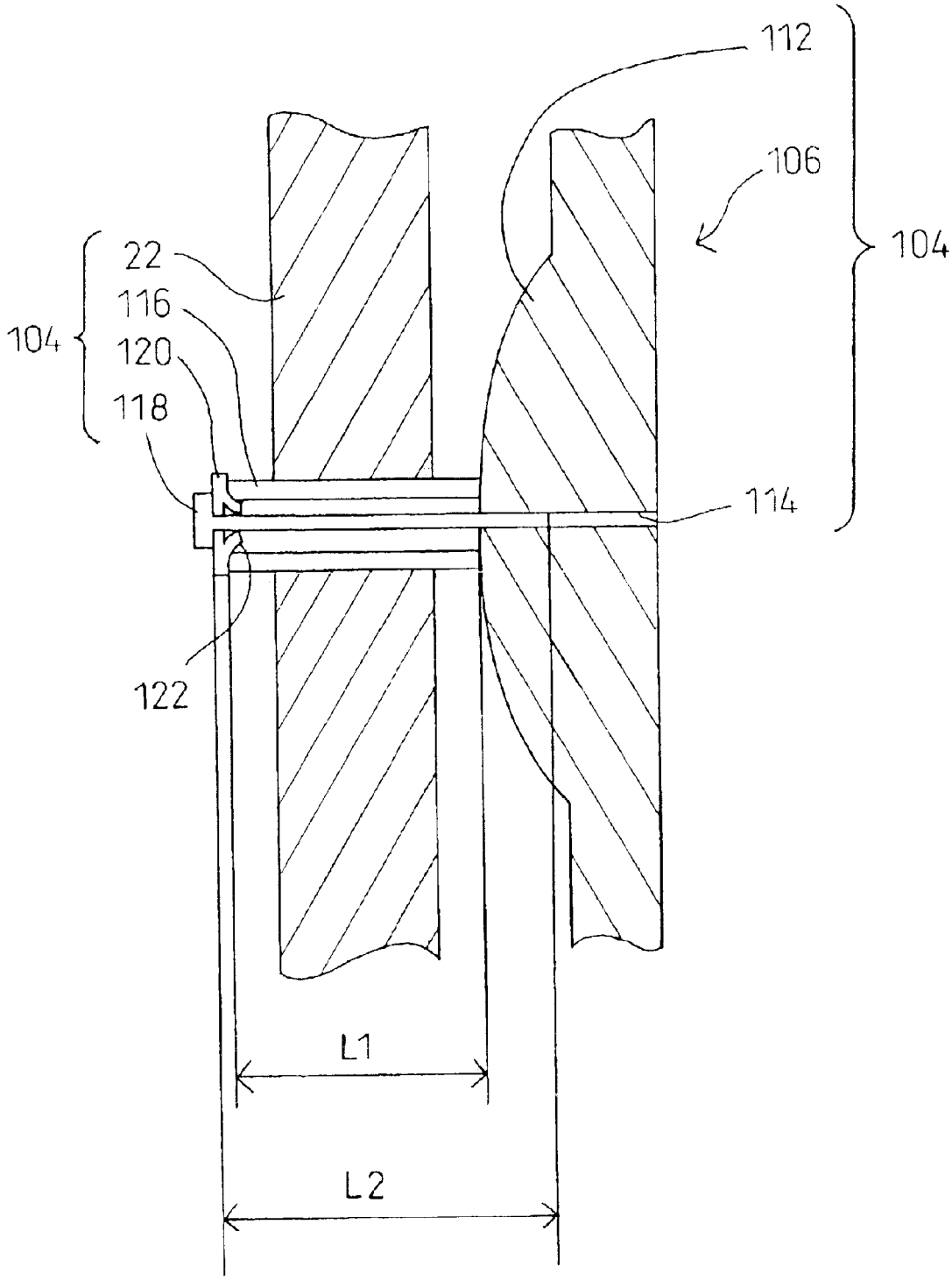
FIG. 12 is a sectional view of the abutment plate and adjusting screw.

A fixing member 104 will now be described. The mounting member 36 is fixed by the fixing member 104 so as to be unrotatable relative to the frame. A metal abutting plate 106 has two through holes 108 and 110 as shown in FIG. 10. Screws are passed through the holes 108 and 110 to be screwed into the annular portions 94 and 96 respectively so that the abutting plate 106 is mounted on the vertical wall 60 of the mounting member 36. The abutting plate 106 has a rear face formed with an arc portion 112 projecting rearward. The arc portion 112 has a furthest projecting portion formed with a female screw 114 extending through the abutting plate 106. The arc portion 112 and a rear opening of the female screw 114 are positioned ahead of a front opening of the female screw 34 formed in a left lower portion of the head 18 of the rear frame 22 as shown in FIG. 2. The female screw 34 of the head 18 extends through the rear frame 22. An adjusting screw 116 as shown in FIG. 11 is engaged with the female screw 34 at the rear of the frame 22. The adjusting screw 116 has a length L1 set so that a front distal end of the screw 116 reaches the rearwardly projecting arc portion when the screw 116 has been engaged with the female screw 34.

The adjusting screw 116 has a central through hole such that the screw is axially hollow. A set-screw 118 is inserted through the rear opening into the through hole of the screw 116. The through hole of the screw 116 has a diameter d1 larger than a diameter d2 of the set-screw 118. The length L1 of the screw 116 is smaller than a length L2 of the set-screw 118. The set-screw 118 is passed through a thin metal locking ring or bushing 120. The locking ring 120 has a central hole and an inner circumferential edge formed with a claw 122 which is formed so that a distal end of the claw 122 comes into slight contact with a screw thread of the set-screw 118. The length L2 of the set-screw 118 is set so that a front distal end (thread portion) of the set-screw 118 is sufficiently engaged with the female screw 114 of the arc portion 112 (at least, 3 threads) when the set-screw 118 with the locking ring 120 has been inserted into the female screw 114 engaged with the head 18.

The following describes components of the respective mechanisms and assembly of the components onto the sewing machine 10. The main shaft 56 rotated by the machine motor 54 is mounted on the mount 24 of the rear frame 22. The needle bar driving mechanism 40 is provided with a rotating shaft 124 joined to the main shaft 56. The rotating shaft 124 includes a bearing metal 126 slidably mounted on an outer circumferential face thereof. The bearing metal 126 serves to obtain smooth rotation and is formed into a circular cylindrical shape. The bearing metal 126 is coaxial with the rotating shaft 124 and the main shaft 56. Accordingly, even when the bearing metal 126 is rotated, the three-dimensional position of the rotating shaft 124 is not changed. The rotating shaft 124 has a right end joined via a universal joint 128 to the main shaft 56. Japanese Patent Application No. 2001-172318 filed by the assignee of the present application discloses an example of a sewing machine using a universal joint for connecting shafts. The rotating shaft 124 further has a left end joined to a needle bar crank 130 vertically moving the needle bar 38 (FIG. 9). The needle bar 38 is mounted on a needle bar mount 132 so as to be vertically moved. The needle bar mount 132 is located on the left of the crank 130. A swinging shaft 134 is inserted into the through hole 88 to be fixed therein so that the needle bar 38 is swung about the shaft.

The needle bar crank 130 is joined to a thread take-up crank 136. The needle thread take-up 42 is supported via a thread take-up support 43 by the thread take-up crank 136. The thread take-up support 43 is swung by the thread take-up crank 136. The thread take-up support 43 is slidably joined to a support shaft (not shown). A bearing metal (not shown) is slidably mounted on the support shaft serving to obtain smooth rotation. A receiving plate 138 formed with two through holes is fixed by screws to the left-hand face of the right side wall 64 so as to be unrotatable and immovable. The through holes of the receiving plate 138 are in alignment with the through holes 70 and 72 of the right side wall 64 respectively. The bearing metals of the rotating shaft 124 and support shaft are force fitted into the through holes of the receiving plate 138 so as to be unrotatable and immovable, respectively.

The rotating shaft 124 is mounted via the bearing metal 126 and the receiving plate 138 in the through hole 70 of the right side wall 64 so as to be rotatable relative to the mounting member 36. Accordingly, even when the mounting member 36 is rotated about the bearing metal 126, the three-dimensional position of the rotating shaft 124 is not changed. The rotating shaft 124 is generally concentric with the main shaft 56. When the rotating shaft 124 is rotated with the main shaft 56, the needle bar 38 is moved vertically reciprocally by the needle bar crank 130. Furthermore, the needle bar mount 132 is mounted in the through hole 88 so as to be positioned in front of the vertical wall 60. Additionally, the support shaft of the thread take-up crank 136 is mounted via the bearing metal in the upper rear through hole 72 of the right side wall 64 so as to be rotatable relative to the mounting member 36. The needle bar crank 130 is joined to the thread take-up crank 136, so that the needle thread take-up 42 is vertically moved via the thread take-up crank 136 and the needle bar crank 130 in phase with the needle bar 38 by rotation of the main shaft 56. During the upward movement of the needle thread take-up 42, the thread take-up support 43 reaches an upwardly recessed escape portion 100. The distal end thread guard of the needle thread take-up 42 is aligned with the needle bar 38. The bearing metals of the rotating and support shafts have respective diameters slightly smaller than the through holes 70 and 72 of the right side wall 64 and accordingly are slidable unless the bearing metals are fitted in the receiving plate 138. When the receiving plate 138 in which the bearing metals have been fitted is fixed by the screws to the mounting member 36, the bearing metals are unrotatable and immovable relative to the mounting member 36.

A presser bar 140 with a presser foot being mounted on its lower end is inserted via a sliding metal into the lower through hole 86 of the vertical wall 60 thereby to be mounted. A member for producing pressure for the presser bar 140 is inserted into the upper through hole 84 thereby to be mounted. A metal circular cylindrical support shaft 142 is slidably inserted in the recess 74 of the left side wall 66. The support shaft 142 is concentric with the rotating shaft 124. The lower front through hole 70 of the right side wall 64 and the recess 74 of the left side wall 66 are surrounded by the annular ribs 76 and 78, and two shafts extend through the surrounded portions respectively.

On the right of the above-described construction are provided a threading bar 146 having a lower end to which a threading portion 144 including a threading hook is fixed and a threading bar guide 148 formed by bending a metal wire for vertical movement of the threading bar guide. The threading bar guide 148 has an upper end extending horizontally and inserted into the through hole 90 and a lower end inserted into a through hole of a fixing plate 150, whereby the threading bar guide 148 is mounted on the mounting member 36. The threading bar guide 148 includes a vertically extending portion with which a moving piece 149 is slidably fitted. The moving piece 149 includes a rearwardly protruding portion which is in contact with a rib of a groove formed along a crossing of a threading groove 102 at both right and left sides thereof. As a result, the moving piece 149 is prevented from being turned about the threading guide 148. The moving piece 149 is adapted to be moved vertically together with the threading bar 146. The groove of the threading portion 102 is formed according to a range of vertical movement of the moving piece 149.

In the above-described construction, the needle bar driving mechanism 40, needle thread take-up driving mechanism 44 and threading mechanism 48 are all mounted on the mounting member 36 and the positional relations among the mechanisms are properly adjusted by the workman. Consequently, the three mechanisms 40, 44 and 48 performing respective functions are assembled into a single module. The needle bar driving mechanism 40 includes the rotating shaft 124, bearing metal 126, needle bar crank 130, needle bar mount 132 and swinging shaft 134. The needle thread take-up driving mechanism 44 includes the thread take-up support 43 and thread take-up crank 136. The threading mechanism 48 includes the threading portion 144, threading bar 146 and threading bar guide 148. Thus, the needle bar driving mechanism 40, needle thread take-up driving mechanism 44 and threading mechanism 48 are mounted between the two side walls 64 and 66 of the mounting member 36 both of which are located outside the mechanisms in parallel with each other. The rotating shaft 124 and the support shaft 142 project rightward and leftward out of the mounting member 36.

Figure 8:
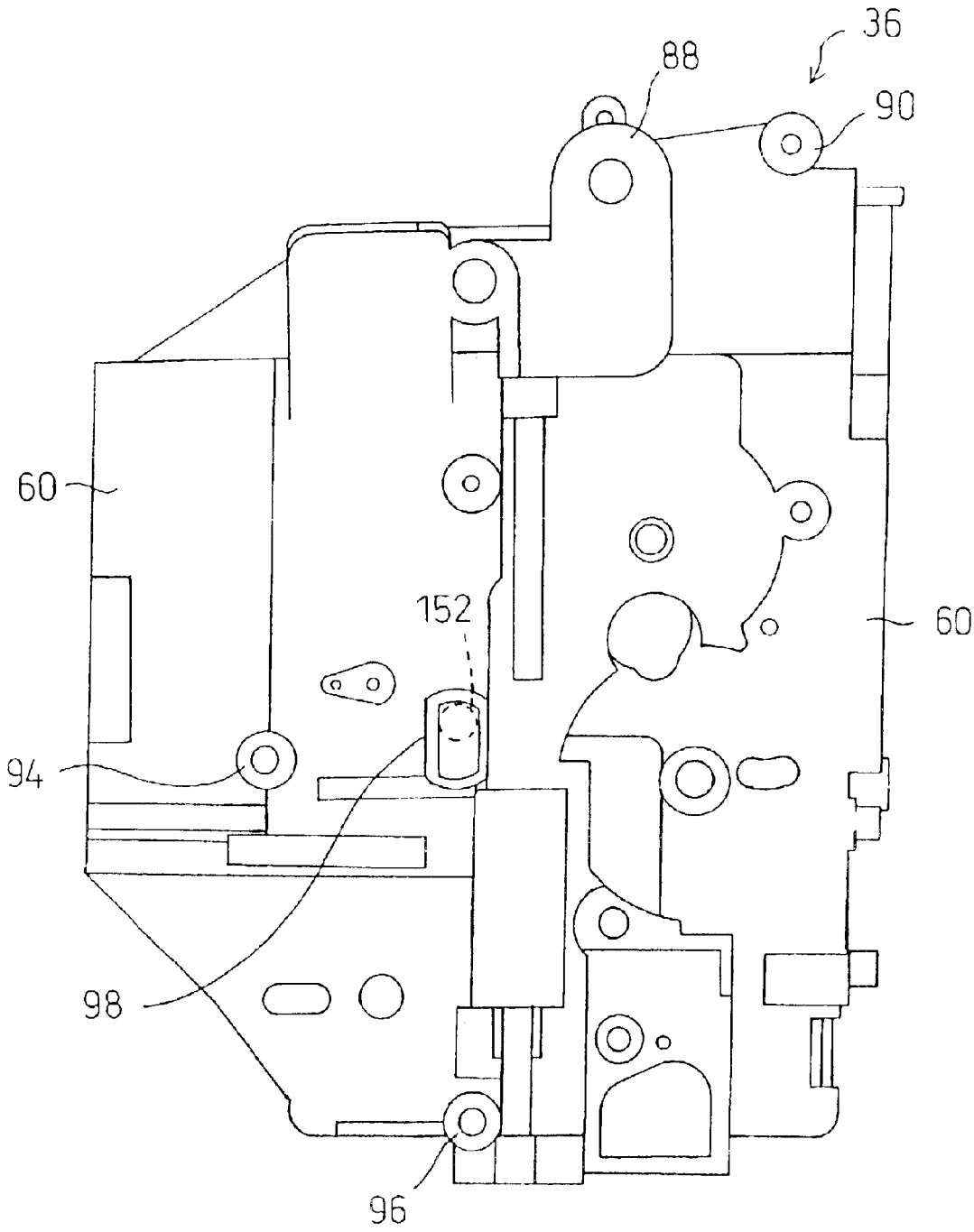
FIG. 8 is a rear view of the mounting member.
Figure 9:
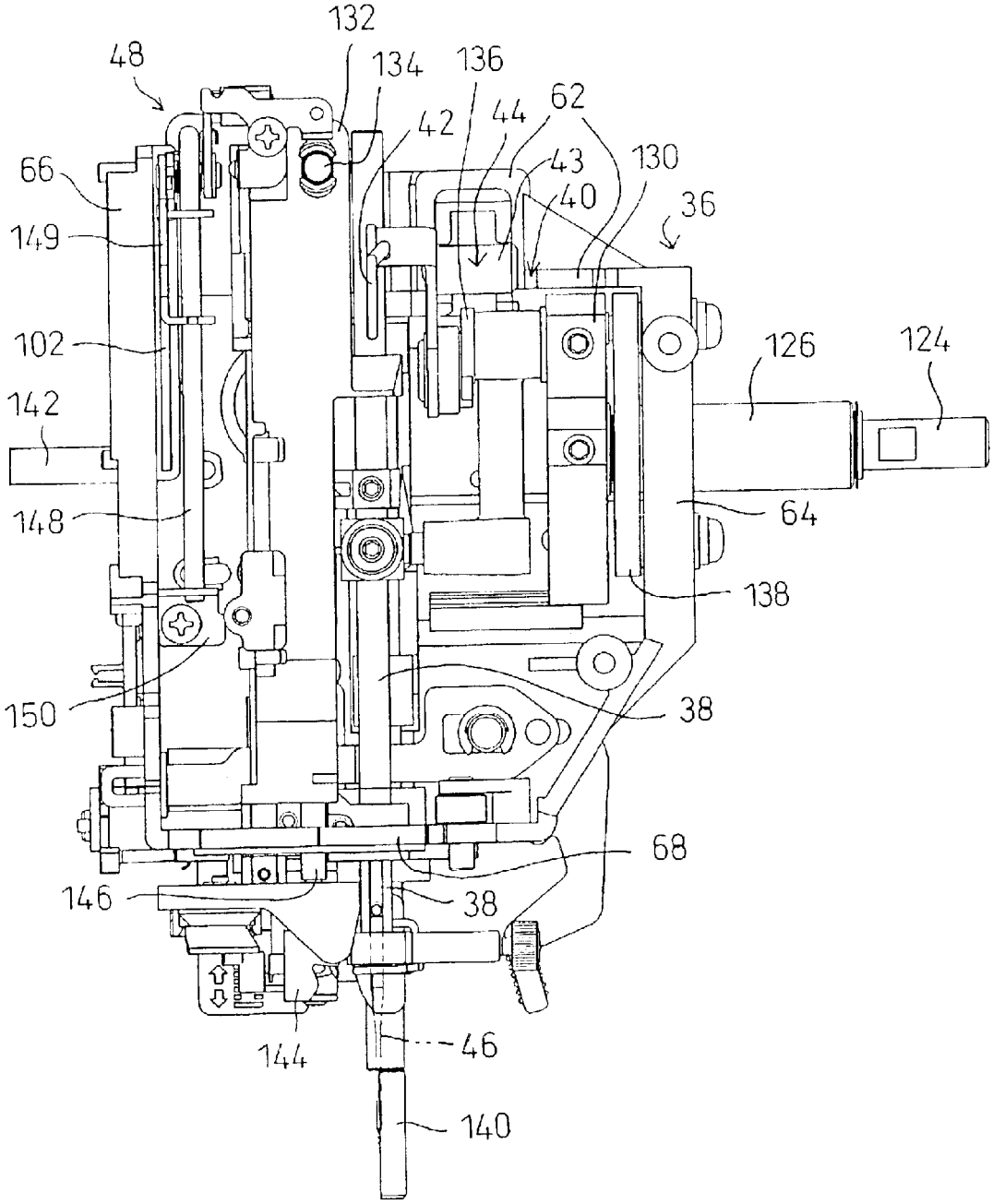
FIG. 9 is a front view of the mounting member on which three mechanisms are mounted.

The rear or outer face of the vertical wall 60 is directed to the front of the rear frame 22 as shown in FIG. 8 after the components performing the three functions have been mounted on the mounting member 36. The mounting member 36 is then caused, by the workman or a conveyer, to come close to predetermined mounting members 26 and 28 corresponding to the head 18 of the frame, through the front opening of the rear frame 22. A cylindrical metal mounting pin 152 is mounted on the mount 30 of the head 18. The hollow protrusion 98 projecting from the rear face of the vertical side wall 60 is caused to cover the mounting pin 152. In this case, the mounting pin 152 has a width or diameter slightly smaller than the opening of the protrusion 98 and accordingly, the mounting pin 152 is covered with the protrusion 98 while the right and left sides of the mounting pin 152 and the right and left sides of the protrusion 98 are slid. Furthermore, the direction in which the mounting member 36 is mounted on the rear frame 22 is basically a back-and-forth direction. However, since the width or diameter of the mounting pin 152 is smaller than the opening of the protrusion 98, the mounting pin can be covered with the projection even when the rear side of the vertical side wall 60 is slightly inclined. More specifically, a specific direction other than the direction in which the mounting member 36 is mounted on the machine frame is the right-and-left direction in the embodiment. When having been covered with the protrusion 98, the mounting member 36 is allowed to be moved back and forth and vertically relative to the rear frame 22 but is limited in the rightward or leftward movement thereof relative to the rear frame 22.

When having reached the predetermined mounts 26 and 28 of the rear frame 22, the bearing metal 126 of the rotating shaft 124 and the support shaft 142 are mounted on the respective mounts 26 and 28 by fixing members 154 and 156 mounted on the rear frame 22 and screws so as to be unrotatable relative to the rear frame 22 and immovable rightward and leftward. Thus, the components of three functions mounted on the mounting member 36 are collectively supported on the rear frame 22. In this case, the mounting member 36 is rotatably mounted on the rear frame 22 at both right and left sides thereof since the bearing metal 126 and the support shaft 142 are rotatable relative to the rear frame. Each of the mounts 26 and 28 has a front face which is recessed into an arc shape. More specifically, the three-dimensional position of the rotating shaft 124 is unchanged even when the bearing metal 126 and support shaft 142 are rotated about a common central axis.

Thus, the left side wall 66 of the mounting member 36 is rotatably supported via the bearing metal 126 and the receiving plate 138 on the rear frame 22 by the bearing metal 126 of the rotating shaft rotated together with the main shaft 56. Furthermore, the right side wall 64 of the mounting member 36 is rotatably supported on the rear frame 22 by the support shaft 142 substantially concentric with the main shaft 56 and the rotating shaft 124. As a result, the mounting member 36 is rotatably supported at both opposite sides thereof such that load is divided into two parts each of which is smaller than load in the case where the mounting member is cantilevered. Consequently, the thickness of the mounting member 36 can be reduced and the mounting member 36 can be rendered suitable for being made from a resin. Since a large thickness may result in buckle, sink mark, shrink or warp in the mounting member, it is desirable to reduce the thickness of the mounting member to a value as small as possible. Since components for driving the needle bar 38 and needle thread take-up 42 are used for the supporting at one of both sides, the construction of the sewing machine 10 can be simplified. In the foregoing embodiment, encounter of a seizing beak of the horizontally rotating shuttle 50 with the needle 46 is adjusted by adjustment of an amount of forward projection of the adjusting screw 116 from the rear frame 22. The lower shaft 58 is fixed to the mount 32 of the rear frame 22 together with the shuttle driving mechanism 52 before the aforesaid adjustment of the shuttle 50.

The adjusting screw 116 is then engaged from the rear opening of the female screw 34 of the head 18, so that the front end of the screw abuts against the arc portion 112 of the adjusting plate or the rear side of the mounting member 36. Thus, the curved face of the arc portion 112 is abutted against the distal flat face of the adjusting screw 116. The abutment prevents further rearward rotational movement of the mounting member 36. The set-screw 118 is inserted by the workman into the hollow interior of the adjusting screw 116 from behind. In this case, the lock ring 120 is fitted with the set-screw 118 and the front distal end of the set-screw reaches the female screw 114 of the arc portion. When turned by the workman, the set-screw 118 is engaged with the abutting plate 106. Furthermore, since the lock ring 120 is held between the rear end of the adjusting screw 116 and the head of the set-screw 118, the engagement of the set-screw 118 prevents forward rotational movement of the mounting member 36 when the set-screw is turned by the workman. In this case, the distal end of claw 122 of the lock ring 120 is in slight contact with the screw thread of the set-screw 118, thereby being elastically deformed slightly so as to be inclined forward. The set-screw 118 is pushed rearward at least in one of obliquely upward and downward directions, whereby the set-screw 118 is prevented from loosening. As a result, the mounting member 36 is disallowed to be rotated relative to the rear frame 22 and accordingly, a fixed positional relation is obtained between the mounting member 36 and the shuttle 50 located below the mounting member. Thus, the relative positional relation is completely fixed between the needle 46 and the shuttle driving mechanism 52.

According to the above-described construction, the cylindrical portion 98 of the vertical wall 60 is sufficiently fitted with the mounting pin 152. Since the mounting member 36 on which the needle bar driving mechanism 40, thread take-up driving mechanism 44 and threading mechanism 48 are mounted is stabilized with respect to at least the right-and-left direction, the productivity of the sewing machine can be improved. The movement of the mounting member 36 may be limited in the vertical direction as well as in the right-and-left direction.

The mounting pin 152 is cylindrical in shape in the foregoing embodiment. However, either one of the limiting portion of the rear frame 22 and the limiting portion of the mounting member 36 may be a protrusion protruding in the back-and-forth direction and the other may be a recess into which the protrusion is inserted. In this construction, when the protrusion is engaged with the recess, the movement of the mounting member 36 relative to the rear frame 22 is allowed in the back-and-forth direction, the movement of the mounting member 36 is limited in the horizontal direction which is a specific direction other than the back-and-forth direction. Accordingly, the mounting pin 152 should not be limited to the cylindrical shape but may be formed into the shape of a triangle pole, square pole, elliptic cylinder or the like. Furthermore, the movement of the mounting member 36 is limited relative to the rear frame 22 in the foregoing embodiment. However, when the mounting member 36 is mounted so that its axis extends in the right-and-left direction, the movement of the mounting member 36 may be limited in the back-and-forth direction which is perpendicular to the right-and-left direction. Additionally, when the mounting member 36 is mounted so that its axis extends in the vertical direction, the movement of the mounting member 36 may be limited in one of the horizontal directions perpendicular to the vertical direction relative to the frame.

Furthermore, the needle bar driving mechanism 40, thread take-up driving mechanism 44 and threading mechanism 48 are mounted on the respective mounts in the foregoing embodiment. These mounts, the limiting portion at the mounting member 36 side and the connecting wall 68 are all formed integrally, and the matching of these portions is unnecessary. Consequently, the mounting member 36 can be formed readily. However, the mounting portions and the limiting portion may be discrete components, which may be mounted on or welded or bonded to the mounting member 36, instead.

The position of the mounting member 36 can be stabilized easily and simply by the engagement between the protrusion and recess in the foregoing embodiment. Consequently, the mounting member 36 can be handled easily and the productivity of the sewing machine can be improved. Although the protrusion is provided on the frame and the recess is provided in the mounting member 36 in the embodiment, the recess may be provided in the rear frame 22 and the protrusion may be provided on the mounting member 36, instead. Furthermore, although one set of the protrusion and recess is provided in the embodiment, a plurality of sets may be provided, instead. In this case, the protrusions need to extend in the same direction.

The two side walls 64 and 66 of the mounting member 36 are connected together by the vertical wall 60 and the connecting wall 68 in the embodiment, whereupon the mounting member 36 has a sufficient rigidity to allow the three mechanisms 40, 44 and 48 to be mounted thereon. The mounting member 36 serving as a module is assembled to or supported on the frame. Since the sewing machine 10 is thus produced, the productivity of the sewing machine can be improved. Additionally, the productivity of the sewing machine can further be improved when components performing other functions, for example, an illuminating device, are mounted on the mounting member 36. Furthermore, the limiting member or cylindrical protrusion 98 is formed on the rear of the mounting member 36 so as to project rearward in the embodiment. Accordingly, the productivity of the sewing machine can be improved since the position of the limiting member is specified more easily as compared with the case where the mounting member is recessed inward from the rear thereof (that is, a mere hole). The limiting member may further be colored with a different color from a color of the resin. For example, the limiting member may be painted red when the resin is white.

The two side walls 64 and 66 of the mounting member 36 are pivotally supported in the foregoing embodiment. Furthermore, the mounting member 36 is formed so as to have a sufficient rigidity to support the needle bar driving mechanism 40 and the thread take-up driving mechanism 44. Both mechanisms 40 and 44 can be adjusted by rotating the mounting member 36. Consequently, the productivity of the sewing machine can be improved. In this case, instead of the circular cylindrical support shaft 142 used in the support portion of the left side wall 66, either one of the rear frame 22 or the left side wall 66 may be formed with an arcuate groove having an arcuate configuration which is a part of a circle concentric with the main shaft 56, whereas the other may be provided with a roller rotated in the groove. Moreover, an arcuate plate having an arcuate configuration which is a part of a circle concentric with the main shaft 56, instead of the roller.

The circular cylindrical ribs 76 and 78 are continuous with the linear ribs 80 and 82 on the outer face of the mounting member 36 respectively in the foregoing embodiment, whereupon the mounting member 36 has a sufficient rigidity to support the needle bar driving mechanism 40 and the thread take-up driving mechanism 44. These mechanisms 40 and 44 can be adjusted by rotating the mounting member 36. Consequently, the productivity of the sewing machine can be improved. However, the circular cylindrical ribs 76 and 78 may be continuous with the linear ribs 80 and 82 inside the mounting member 36 respectively, instead. Furthermore, although the mounting member 36 is mounted on the rear frame 22 in the foregoing embodiment, it may be mounted on the front frame 20, instead. The mounting member 36 is disposed in the space defined by the two frames 20 and 22 in the foregoing embodiment. As a result, the mounting member 36 is unexposed outside the sewing machine 10. However, when the front of the mounting member 36 includes a part serving as the appearance of the sewing machine 10, the part of the front of the mounting member may constitute the appearance of the sewing machine.

Figure 13:
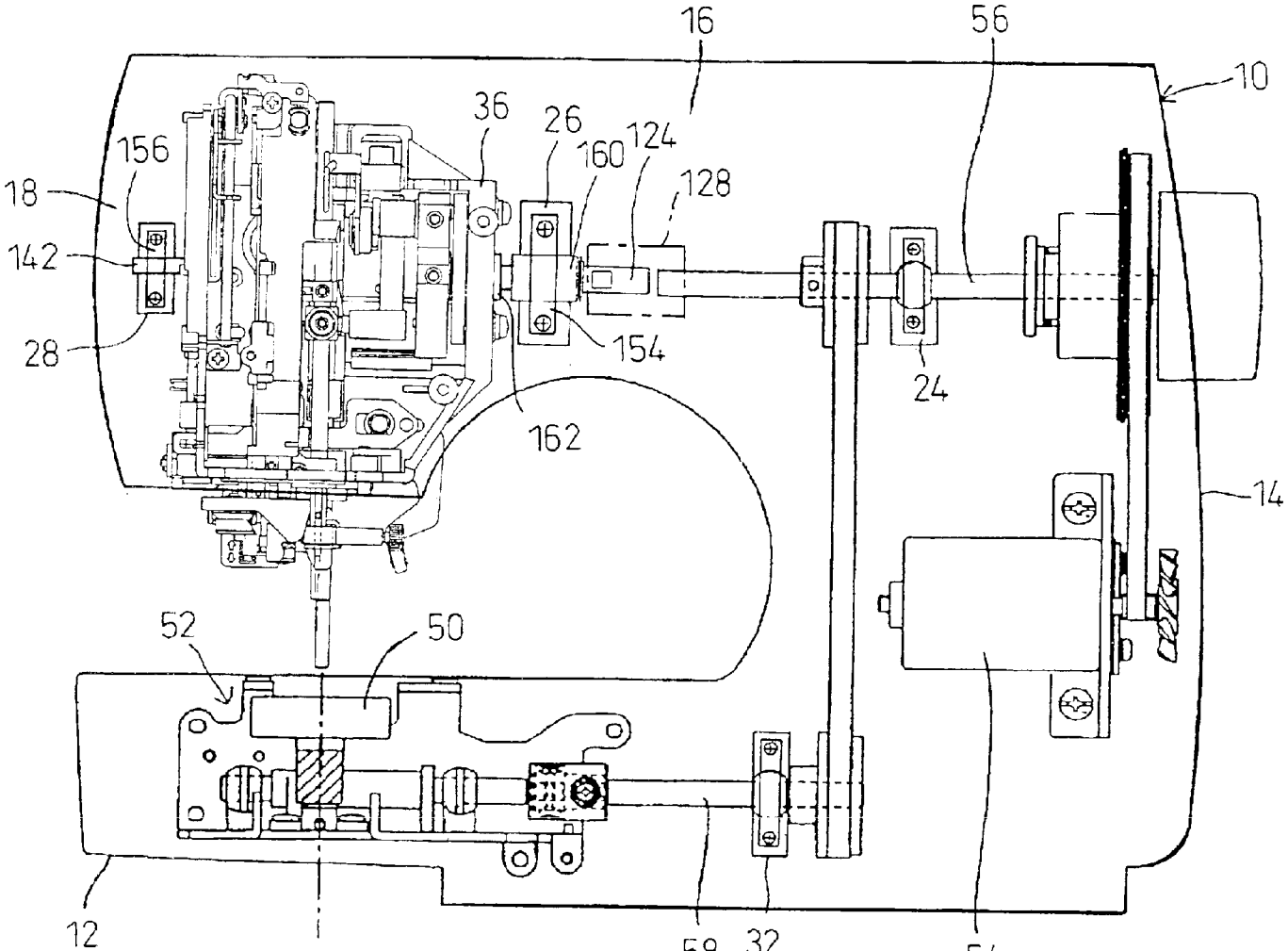
FIG. 13 is a view similar to FIG. 1, showing the sewing machine in accordance with another embodiment of the invention.

The rotating shaft 124 constituting the left end of the main shaft 56 is discrete from the main shaft and mounted on the mounting member 36 in the foregoing embodiment. However, the main shaft 56 may be joined directly to the needle bar crank 130 enclosed in the mounting member 36, instead. In this case, a bearing metal or bearing is provided between the main shaft 56 and the mounting member 36 to rotatably support the main shaft. Furthermore, the mounting member 36 is pivotally mounted on the rear frame 22 together with the rotating shaft 124 by the bearing metal 126 before the bearing metal 138 of the rotating shaft 124 is fixed to the frame 22. On the other hand, the rotating shaft 124 may be mounted on a bearing metal 160 discrete from the mounting member 36, which bearing metal may further be mounted on the frame 22, instead, as shown as a second embodiment in FIG. 13. In this construction, when a bearing metal or bearing 162 is fixed to the mounting member 36 so as to be unrotatable and immovable relative to the mounting member, the mounting member 36 is rotatably supported via the bearing metal or bearing 162 on the rear frame 22.

Only the right side wall 64 is formed with the obtuse bent portion in the foregoing embodiment. However, only the left side wall 66 may be formed with an obtuse bent portion or both right and left side walls 64 and 66 may be formed with respective obtuse bent portions, instead. The right side wall 64 is located at a "sleeve" of the sewing machine 10. The sleeve requires a large space since a right arm of the user is located. Accordingly, an amount of expansion of the right side wall 64 into the sleeve is desired to be small. An amount of expansion is small in the embodiment since an obtuse bent portion is formed in the lower part of the right side wall 64, whereupon the sewing machine 10 can provide a high working efficiency. Furthermore, the bearing metal 126 is directly fixed by the fixing member 154 in the embodiment. However, another or a second bearing metal may slidably be mounted on the first bearing metal 126 and may be fixed by the fixing member 154. Thus, the bearing metal may have a double structure.

The bearing metal 126 and the support shaft 142 are fixed after the encounter adjustment in the foregoing embodiment. The encounter adjustment may be carried out after the bearing metal 126 and the support shaft 142 have been fixed, instead. In one method, force overcoming the force fixing the bearing metal 126 and the support shaft 142 is applied to the mounting member 36, so that the mounting member is rotated about the bearing metal 126 and the support shaft 142 against the fixing force. In this construction, for example, a flat plate is employed as the fixing member 154 and recesses are formed in the mounts 26 and 28 respectively. The recesses have depths substantially equal to diameters of the bearing metal 126 and the support shaft 142 respectively. The bearing metal 126 and the support shaft 142 are inserted into the respective recesses, and the flat plate is fixed by screws in front of the recesses. The bearing metal 126 and the support shaft 142 are held between the respective recesses and the flat plate such that frictional forces induced between the bearing metal 126 and the support shaft 142 and the recess and the flat plate fix the bearing metal and the support shaft. In this construction, the mounting member 36 is rotated about the bearing metal 126 and the support shaft 142 when the aforesaid overcoming force is applied, via the adjusting screw 36 or another member extending through the hollow interior of the screw 36, to the abutting plate 106, whereupon the encounter can be adjusted. This construction is advantageous particularly in the foregoing embodiment in which the module composed of the components is mounted on the non-die-cast resin frame. The reason for this is that the rigidity tends to be insufficient in the single half-divided state of the frame 22 without die casting and accordingly, the encounter is not always adjusted accurately even when the adjustment is carried out in this state of the frame. That is, the frames 20 and 22 need to be combined together into a housing so that the rigidity is increased. However, when the frames 20 and 22 are formed into a housing, the front of the frame 22 is covered with the frame 20 and accordingly, the screws of the fixing members 154 and 156 cannot be tightened and loosened. In view of this problem, the screws of the fixing members 154 and 156 need to be tightened up before the frames 20 and 22 are assembled into a housing. In the above-described sewing machine 10, the frames 20 and 22 are assembled into the housing after the bearing metal 126 and the support shaft 142 are once fixed. Thereafter, the encounter adjustment can be carried out.

Holes may be formed in the front frame 20 in order that the screws of the fixing members 154 and 156 may be operated outside the sewing machine 10. Furthermore, although the lock ring is provided for preventing the set-screw 118 from loosening in the foregoing embodiment, another lock ring may be provided for preventing the adjusting screw 116 from loosening.

As obvious from the foregoing, the mounting member 36 is pivotally mounted at the two side walls 64 and 66 on the rear frame 22. The load due to the needle bar driving mechanism 40 and the thread take-up driving mechanism 44 is dispersed. Both of the mechanisms are supported on the mounting member 36. The mechanisms are adjusted by pivoting the mounting member 36. Consequently, the productivity of the sewing machine can be improved. Furthermore, the circular cylindrical ribs are continuous with the other linear ribs, whereupon the rigidity of the resin mounting member 36 is improved. These mechanisms 40 and 44 can be adjusted by rotating the mounting member 36. Consequently, the productivity of the sewing machine can be improved.

The mounting member 36 is mounted on the machine frames 20 and 22. The limiting members limit the movement of the mounting member 36 relative to the frames 20 and 22. Accordingly, when the mounting member 36 is mounted on the machine frames 20 and 22, the position of the mounting member 36 on which the needle bar driving mechanism 40, the thread take-up driving mechanism 44 and the threading mechanism 48 are mounted can be rendered stable. Consequently, the productivity of the sewing machine can be improved. Furthermore, the limiting member allows the movement of the mounting member 36 relative to the machine frame in the back-and-forth and vertical directions but limits the movement of the mounting member in the horizontal direction serving as the specific direction. Consequently, the productivity of the sewing machine can be improved since the position of the mounting member 36 on which the needle bar driving mechanism 40, the thread take-up driving mechanism 44 and the threading mechanism 48 are mounted is stable when the mounting member is mounted on the machine frame.

The resin mounting member 36 includes mounts and the limiting portion both formed integrally in the sewing machine 10. Consequently, the productivity of the sewing machine can be improved since the positional relations among the mounts and the limiting portion need not be matched. Furthermore, when the protrusion is engaged with the recess, the movement of the mounting member 36 relative to the machine frame is allowed but the movement of the mounting member in the horizontal direction which is a specific direction. Consequently, the position of the mounting member 36 can be stabilized by the easy and simple construction and accordingly, the mounting member 36 can be handled easily. Consequently, the productivity of the sewing machine can be improved.

The two side walls 64 and 66 of the mounting member 36 are connected together by the vertical wall 60 and the connecting wall 68 in the embodiment, whereupon the mounting member 36 has a sufficient rigidity to allow the three mechanisms 40, 44 and 48 to be mounted thereon. The mounting member 36 is assembled to or supported on the frame. Since the sewing machine 10 is thus produced, the productivity of the sewing machine can be improved. Furthermore, the movement of the mounting member 36 relative to the machine frame in the back-and-forth and vertical directions is allowed but the movement of the mounting member in the horizontal direction is limited. Accordingly, the productivity of the sewing machine can be improved since the position of the mounting member 36 on which the needle bar driving mechanism 40, the thread take-up driving mechanism 44 and the threading mechanism 48 are mounted is stable.

The limiting member or cylindrical protrusion 98 is formed from the resin on the rear of the mounting member 36 so as to project rearward in the embodiment. Accordingly, the productivity of the sewing machine can be improved since the position of the limiting member is specified more easily as compared with the case where the mounting member is recessed inward from the rear thereof. Furthermore, the two side walls 64 and 66 of the mounting member 36 are formed integrally from the resin so as to be connected together by the vertical wall and the connecting wall. Consequently, the relative positions of them are not required to be matched and the productivity of the sewing machine can be improved.

The limiting member is formed from the resin on the rear of the mounting member 36 in the embodiment. Accordingly, the relative positions of them are not required to be matched. Furthermore, the two side walls 64 and 66 of the mounting member 36 are formed integrally from the resin so as to be connected together by the vertical wall and the connecting wall. Moreover, the limiting member is formed from the resin on the rear of the mounting member 36 in the embodiment. Consequently, the relative positions of them are not required to be matched and the productivity of the sewing machine can be improved and the productivity of the sewing machine can be improved.

The two side walls 64 and 66 and the vertical wall of the mounting member 36 are formed integrally from the resin. The intersection between either one of the side walls 64 and 66 and the vertical wall has the rib formed integrally from the resin so as to extend along the intersection. The rib is caused into contact with one of the mechanisms mounted on the mounting member 36. Consequently, the rigidity of the mounting member 36 can further be improved. Furthermore, the vertical wall and the two side walls are formed integrally and one of the side walls is bent so as to make an obtuse angle. Consequently, the rigidity of the mounting member 36 can be improved.

The foregoing description and drawings are merely illustrative of the principles of the present invention and are not to be construed in a limiting sense. Various changes and modifications will become apparent to those of ordinary skill in the art. All such changes and modifications are seen to fall within the scope of the present invention as defined by the appended claims.

We claim:

1. A sewing machine comprising:

a needle bar driving mechanism for vertically moving a needle bar by rotation of a main shaft;

a needle thread take-up driving mechanism for vertically moving a needle thread take-up by rotation of the main shaft in phase with vertical movement of the needle bar;

a mounting member on which the needle bar driving mechanism and the needle thread take-up driving mechanism are mounted; and a machine frame supporting the mounting member, wherein the mounting member has two sides provided on the left and right of the needle bar driving mechanism and the needle thread take-up driving mechanisms respectively, the mounting member is supported in one of the sides by the main shaft, a rotating shaft rotated with the main shaft or a bearing member for the main shaft or the rotating shaft so that the mounting member is rotated relative to the machine frame and the main shaft or the rotating shaft, the mounting member is supported on the other side by the main shaft or a supporting shaft substantially concentric with the rotating shaft and extending in a same direction as the rotating shaft so that the mounting member is rotated relative to the machine frame and the main shaft or the rotating shaft, and the mounting member is fixed by a fixing member so that rotation thereof is disallowed.

2. A sewing machine according to claim 1, wherein:

the sides of the mounting member are formed from a resin integrally with each other so that the sides are spaced from each other in a right-and-left direction;

the sides of the mounting member have ribs formed thereon so as to protrude axially with respect to the main shaft or the rotating shaft and further formed annularly so as to surround a portion of said one side supported by the main shaft or the rotating shaft and a portion of said other side supported by the supporting shaft, respectively; and the annularly protruding ribs have further ribs formed to extend in a line linearly so as to be perpendicular thereto as viewed from a direction in which the ribs protrude, respectively.

3. A sewing machine according to claim 1, further comprising:

a threading mechanism mounted on the mounting member for threading a needle attached to a lower end of the needle bar; and a limiting member limiting movement of the mounting member relative to the machine frantic concerning a predetermined direction other than a direction in which the mounting member is mounted on the machine frame.

4. A sewing machine according to claim 3, wherein the machine frame has a front formed with an opening, the mounting member is mounted on the front of the machine frame, and the limiting member allows movement of the mounting member relative to the machine frame both in a fore-and-aft direction and vertically and limits horizontal movement of the mounting member which is the predetermined direction.

5. A sewing machine according to claim 3, wherein the mounting member is made from a resin and includes mounting portions on which the needle bar driving mechanism, needle thread take-up driving mechanism and threading mechanism are mounted respectively and a limiting portion serving as the limiting member in cooperation with the limiting of the machine frame side, the mounts and the limiting portion being formed integrally with the mounting member.

6. A sewing machine according to claim 4, wherein either one of the limiting portions provided at the machine frame side and formed in the mounting member is a protrusion extending in the fore-and-aft direction and the other is a recess into which the protrusion is inserted.

7. A sewing machine comprising:

a needle bar driving mechanism for vertically moving a needle bar;

a needle thread take-up driving mechanism for vertically moving a needle thread take-up in phase with vertical movement of the needle bar;

a threading mechanism for threading a needle mounted on a lower end of the needle bar;

a mounting member on which the needle bar driving mechanism, needle thread take-up driving mechanism and threading mechanism are mounted;

a machine frame supporting the mounting member; and a limiting member limiting movement of the mounting member relative to the machine frame concerning a predetermined direction other than a direction in which the mounting member is mounted on the machine frame.

8. A sewing machine according to claim 7, wherein the machine frame has a front formed with an opening, the mounting member is mounted on the front of the machine frame, and the limiting member allows movement of the mounting member relative to the machine frame both in a fore-and-aft direction and vertically and limits horizontal movement of the mounting member which is the predetermined direction.

9. A sewing machine according to claim 7, wherein the mounting member is made from a resin and includes mounting portions on which the needle bar driving mechanism, needle thread take-up driving mechanism and threading mechanism are mounted respectively and a limiting portion serving as the limiting member in cooperation with the limiting of the machine frame side, the mounts and the limiting portion being formed integrally with the mounting member.

10. A sewing machine according to claim 7, wherein either one of the limiting portions provided at the machine frame side and formed in the mounting member is a protrusion extending in the fore-and-aft direction and the other is a recess into which the protrusion is inserted.

11. A sewing machine according to claim 7, further comprising a threading mechanism mounted on the mounting member for threading a needle attached to a lower end of the needle bar, wherein the mounting member includes a vertical plane substantially perpendicular to a fore-and-aft direction, two sides substantially perpendicular to the vertical plane and extending forward and a connecting portion connecting the sides together at an opposite side spaced away from the vertical plane.

12. A sewing machine according to claim 11, wherein the machine frame has a front formed with an opening, the mounting member is mounted on the front of the machine frame, and the mounting member has a rear provided with a limiting portion allowing movement of the mounting member relative to the machine frame both in a fore-and-aft direction and vertically and limiting horizontal movement of the mounting member.

13. A sewing machine according to claim 12, wherein the limiting portion is formed on the rear of the mounting member into a shape of a cylinder protruding rearward.

14. A sewing machine according to claim 11, wherein the mounting member is made from a resin, and the vertical plane, the two sides and the connecting portion are formed integrally.

15. A sewing machine according to claim 12, wherein the mounting member is made from a resin and the rear and the limiting portion are formed integrally.

16. A sewing machine according to claim 12, wherein the mounting member is made from a resin, and the vertical plane, the two sides and the connecting portion are formed integrally with the limiting portion.

17. A sewing machine according to claim 11, wherein the mounting member is made from a resin, and the vertical plane and the two sides are formed integrally with each other, the mounting member includes a rib provided along a portion where the vertical plane intersects one of the sides, and a component is in contact with the rib, the component constituting any one of the needle bar driving mechanism, needle thread take-up driving mechanism and threading mechanism.

18. A sewing machine according to claim 11, wherein the mounting member is made from a resin, the vertical plane and the two sides are formed integrally with each other, and either one of the two sides includes an outer middle portion so bent as to form an obtuse angle as viewed in a direction opposite to the direction in which the side of the mounting member projects.

19. A sewing machine comprising:

a needle bar driving mechanism for vertically moving a needle bar;

a needle thread take-up driving mechanism for vertically moving a needle thread take-up in phase with vertical movement of the needle bar;

a threading mechanism for threading a needle mounted on a lower end of the needle bar;

a mounting member on which the needle bar driving mechanism, needle thread take-up driving mechanism and threading mechanism are mounted;

a machine frame supporting the mounting member; and a limiting member limiting movement of the mounting member relative to the machine frame concerning a predetermined direction other than a direction in which the mounting member is mounted on the machine frame, wherein the mounting member includes a vertical plane substantially perpendicular to a fore-and-aft direction, two sides substantially perpendicular to the vertical plane and extending forward and a connecting portion connecting the sides together at an opposite side spaced away from the vertical plane.

20. A sewing machine according to claim 19, wherein the machine frame has a front formed with an opening, the mounting member is mounted on the front of the machine frame, and the mounting member has a rear provided with a limiting portion allowing movement of the mounting member relative to the machine frame both in a fore-and-aft direction and vertically and limiting horizontal movement of the mounting member.

21. A sewing machine according to claim 20, wherein the limiting portion is formed on the rear of the mounting member into a shape of a cylinder protruding rearward.

22. A sewing machine according to claim 19, wherein the mounting member is made from a resin, and the vertical plane, the two sides and the connecting portion are formed integrally.

23. A sewing machine according to claim 20, wherein the mounting member is made from a resin and the rear and the limiting portion are formed integrally.

24. A sewing machine according to claim 20, wherein the mounting member is made from a resin, and the vertical plane, the two sides and the connecting portion are formed integrally with the limiting portion.

25. A sewing machine according to claim 19, wherein the mounting member is made from a resin, and the vertical plane and the two sides are formed integrally with each other, the mounting member includes a rib provided along a portion where the vertical plane intersects one of the sides, and a component is in contact with the rib, the component constituting any one of the needle bar driving mechanism, needle thread take-up driving mechanism and threading mechanism.

26. A sewing machine according to claim 19, wherein the mounting member is made from a resin, the vertical plane and the two sides are formed integrally with each other, and either one of the two sides includes an outer middle portion so bent as to form an obtuse angle as viewed in a direction opposite to the direction in which the side of the mounting member projects.

27. A sewing machine comprising:

a needle bar driving mechanism for vertically moving a needle bar by rotation of a main shaft;

a needle thread take-up driving mechanism for vertically moving a needle thread take-up by rotation of the main shaft in phase with vertical movement of the needle bar;

a mounting member on which the needle bar driving mechanism and the needle thread take-up driving mechanism are mounted so that the mounting member and said mechanisms constitute a module; and a machine frame to which the mounting member constituting the module is assembled, the machine frame including a front frame which has an opening formed in a rear side thereof and is recessed forward, and a rear frame which has an opening formed in a front side thereof and is recessed rearward, the opening of the front frame and the opening of the rear frame being placed opposite each other, wherein the mounting member is attached to one of the front frame or the rear frame at the opening side of the respective front frame or rear frame.

28. A sewing machine according to claim 27, further comprising a threading mechanism for threading a needle mounted on a lower end of the needle bar, the threading mechanism being mounted on the mounting member thereby to constitute a module.

29. A sewing machine according to claim 27, wherein the frame to which the mounting member is attached is the rear frame and the mounting member located at the front opening side of the rear frame is attached to the rear frame.

30. A sewing machine comprising:

a needle bar driving mechanism for vertically moving a needle bar by rotation of a main shaft;

a needle thread take-up driving mechanism interlocked with vertical movement of the needle bar for vertically moving a needle thread take-up by rotation of the main shaft;

a mounting member on which the needle bar driving mechanism and the needle thread take-up driving mechanism are mounted so as to constitute a module, the mounting member including a rear vertical wall having two side ends and two side walls extending from the side ends of the vertical wall respectively so that the mounting member is open frontward with respect to the sewing machine; and a machine frame to which the mounting member constituting the module is assembled, wherein the needle bar driving mechanism includes a rotating shaft joined to the main shaft so as to be rotated with rotation of the main shaft.

31. A sewing machine according to claim 30, wherein the needle bar driving mechanism includes a needle bar crank joined to the rotating shaft so that the needle bar crank is moved by rotation of the rotating shaft with rotation of the main shaft, thereby moving the needle bar vertically.

32. A sewing machine according to claim 31, wherein the needle thread take-up driving mechanism includes a needle thread take-up crank joined to the needle bar crank so that the needle thread take-up crank is moved by rotation of the rotating shaft with rotation of the main shaft, thereby moving the needle thread take-up vertically.

* * * * *